US007463718B2

(12) United States Patent
Fischer et al.

(10) Patent No.: US 7,463,718 B2
(45) Date of Patent: Dec. 9, 2008

(54) X-RAY DIAGNOSTIC DEVICE FOR DIGITAL RADIOGRAPHY

(75) Inventors: Klaus Fischer, Erlangen (DE); Andreas Meyer, Möhrendorf (DE)

(73) Assignee: Siemens Aktiengesellschaft, Munich (DE)

( * ) Notice: Subject to any disclaimer, the term of this patent is extended or adjusted under 35 U.S.C. 154(b) by 216 days.

(21) Appl. No.: 11/101,623

(22) Filed: Apr. 7, 2005

(65) Prior Publication Data

US 2005/0226381 A1 Oct. 13, 2005

(30) Foreign Application Priority Data

Apr. 7, 2004 (DE) ..... 10 2004 017 180

(51) Int. Cl.
*H05G 1/44* (2006.01)

(52) U.S. Cl. ..... 378/108; 378/97

(58) Field of Classification Search ..... 378/97, 378/108

See application file for complete search history.

(56) References Cited

U.S. PATENT DOCUMENTS 4,119,856 A 10/1978 Franke
4,639,943 A * 1/1987 Heinze et al. ..... 378/96
4,703,496 A * 10/1987 Meccariello et al. ..... 378/98.7
4,796,286 A * 1/1989 Ochmann et al. ..... 378/108
4,797,905 A * 1/1989 Ochmann et al. ..... 378/108
4,803,716 A * 2/1989 Ammann et al. ..... 378/155
5,012,504 A * 4/1991 McFaul et al. ..... 378/108
5,388,138 A * 2/1995 Fujiwara ..... 378/108
5,664,000 A * 9/1997 Van Woezik et al. ..... 378/98.7
6,067,343 A * 5/2000 Brendler et al. ..... 378/98.7
6,151,383 A * 11/2000 Xue et al. ..... 378/108
6,333,963 B1 * 12/2001 Kaifu et al. ..... 378/98.2
6,430,258 B1 * 8/2002 Spaak ..... 378/98.7
7,079,189 B2 * 7/2006 Tsujii et al. ..... 348/372
2005/0069086 A1 * 3/2005 Deych et al. ..... 378/112

FOREIGN PATENT DOCUMENTS

DE 37 41 760 C2 5/2000
EP 0 362 427 B1 4/1990

* cited by examiner

*Primary Examiner*—Edward J Glick
*Assistant Examiner*—Thomas R Artman

(57) ABSTRACT

The invention relates to an X-ray diagnostic device for digital radiography with a high voltage generator (1), an X-ray tube (2) for generating an X-ray bundle (3), an image converter (5 to 9) arranged in the radiation path behind a patient (4), and a control device (15), which is fed one of the signals corresponding to the dose in question, whereby the image converter (5 to 9) and a the image converter (5 to 9) whereby the image converter (5 to 9) comprises an Iontomat chamber (5) connected to the control device (15) and a circuit arrangement (12) for automatic voltage regulation (AVR) without idle time.

11 Claims, 1 Drawing Sheet

X-RAY DIAGNOSTIC DEVICE FOR DIGITAL RADIOGRAPHY

CROSS REFERENCE TO RELATED APPLICATIONS

This application claims priority to the German application No. 10 2004 017 180.7, filed Apr. 7, 2004 which is incorporated by reference herein in its entirety.

FIELD OF INVENTION

The invention relates to an X-ray diagnostic device for digital radiography with a high voltage generator, an X-ray tube for generating an X-ray beam bundle, an image converter arranged behind a patient in the radiation path, and a control device which is fed a signal which corresponds to the dose in question. X-ray diagnostic devices of this type serve to create recordings and to reproduce X-ray images on the monitor.

BACKGROUND OF INVENTION

In digital radiography, the following exposure techniques are applied in fluoroscopy systems:

An iontomat chamber is an exposure measurement device used during the exposure of an X-ray film in a destination device, whilst the exposure of digital X-ray recordings takes place behind an X-ray image amplifier, the output fluorescent screen of which is scanned by a television camera, a CCD camera for instance. To do this, in the optical parallel radiation path between the X-ray image amplifier and the television camera, a part of the light is deflected onto a multiplier or a switchable array of photodiodes as light sensors, as disclosed for example in EP 0 362 427 B1. This system is disadvantageous in that two exposure systems are required and the light extraction in the parallel radiation path requires a costly optical solution.

SUMMARY OF INVENTION

An object of the invention is to create an X-ray diagnostic device enabling a correct exposure with only one exposure system.

The object is achieved by the claims. In this manner, all recordings can be exposed appropriately for the dose involved using the Iontomat chamber. In fluoroscopy, the image enhancing controller (AVR) without idle time (dead time) serves to compare the Gx drop and other non-linear characteristics of the X-ray image amplifier.

It has proven to be advantageous for the image enhancing controller (AVR) to comprise an image memory, which is connected to a multiplication stage in which a circuit arrangement for ROI average value formation to determine an actual value is linked to the input of the image memory, said circuit arrangement being connected to a comparison circuit for comparison with a target value, the output of which being connected to the second input of the multiplication stage.

In accordance with the invention a circuit arrangement for exposure correction can be connected to the comparison circuit, by means of which the target value can be changed.

A limiter stage can advantageously be connected to the comparison circuit, said limiter stage being connected to the second input of the multiplication stage.

It has proven to be advantageous for the Iontomat chamber and the circuit arrangement for determining an actual value to comprise measurement fields, the arrangements and/or spatial positions of which correspond.

Dependencies on the brightness of the image amplifier can be taken into account if the circuit arrangement for exposure correction comprises look-up tables, in which kV dependencies on the brightness of the image amplifier are stored.

In accordance with the invention the image conversion unit can comprise an X-ray image amplifier television chain with an X-ray image amplifier, optics, and a television camera, the television camera being either a video camera or a CCD image converter. Alternatively, the image converter can comprise a solid-state image converter.

X-ray recordings can be created in a simple manner if the image converter comprises a target device.

BRIEF DESCRIPTION OF THE DRAWINGS

The invention is described in more detail below with reference to an exemplary embodiment shown in the drawing, in which.

DETAILED DESCRIPTION OF INVENTION

Figure 1:
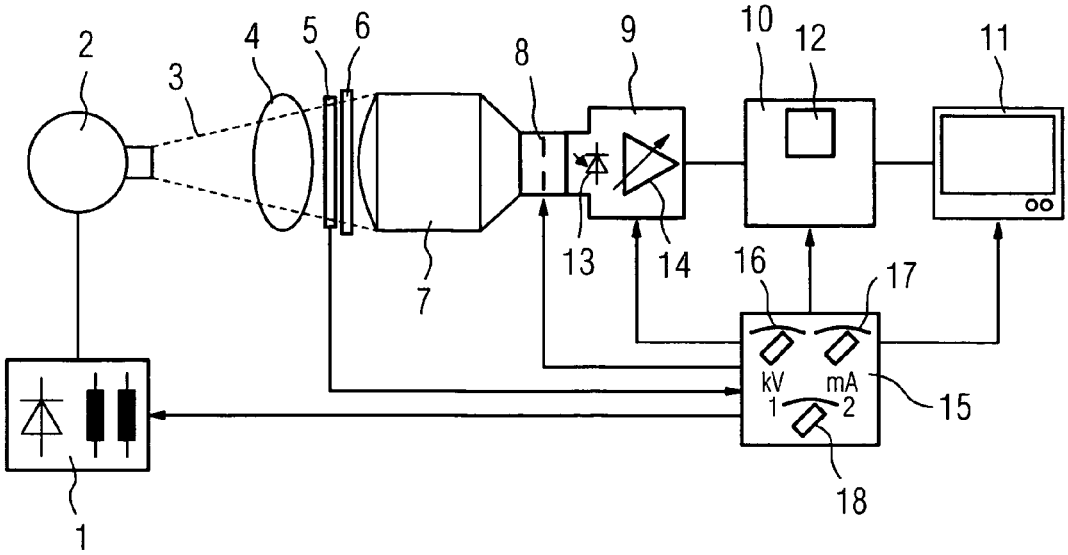
FIG. 1 shows an X-ray diagnostic device according to the invention.

The electrical design of the X-ray device according to the invention is shown in the figure, said X-ray device having a high voltage generator 1 which supplies an X-ray tube 2, in whose radiation path 3 a patient 4 is located. An Iontomat chamber 5 and a target device 6 for recording X-ray films are arranged in the radiation path behind the patient 4. A subsequent X-ray amplifier 7 in the radiation path 3 is linked to iris and grey filters with a television camera 9 by means of optics 8, the output signal of said television camera 9 being fed to the processing circuit 10. The Iontomat chamber 5 is known to have switchable measurement fields, by means of which the region of interest (ROI) can be selected. The iris with the grey filter serves to achieve the desired dynamics.

A monitor 11 for reproducing the processed X-ray radiation image is connected to the processing circuit 10. The processing circuit 10 can for example contain a subtraction device, integration stage, image memory and converters.

Furthermore, the processing circuit 10 according to the invention comprises a circuit arrangement 12 for automatic image enhancing (AVR) without idle time, which processes the current video signal online, so that its brightness can be regulated on the monitor and reproduced as a visible X-ray image.

The television camera 9 can comprise a CCD image converter 13 for instance, the video signal of which is routed in a video amplifier 14 with an adjustable amplification to the output of the television camera 9 which can then be fed to the processing circuit 10.

The X-ray diagnostics device has a control device 15 which is connected to the high voltage generator 1, the television camera 9, the processing circuit 10 and the monitor 11, these being supplied with control signals. The Iontomat chamber 5 supplies a signal corresponding to the dose in question to the control device 15, from which the control device 15 calculates the cut-off time for the high voltage generator 1.

For the purpose of controlling the high voltage generator 1, adjustment means 16 for the X-ray tube voltage kV and adjustment means 17 for the X-ray tube current mA are provided. By means of a switch 18, several dose stages, in this case two dose stages, can be adjusted at the high voltage generator 1. With the adjustment of the desired dose stage at the high voltage generator 1, the corresponding amplification stage at the video amplifier 14 is also selected, so that an increase in the dose and thus a more intensive exposure of the television camera 9 results in a lower amplification of the video amplifier 14. The image brightness remains the same on the monitor 11 irrespective of the selected dose stage. If the dose is doubled with a two-stage switch 18, this dose stage of the television camera 9 is communicated by the control device 15, so that its amplification is halved by correspondingly switching the video amplifier 14.

Figure 2:
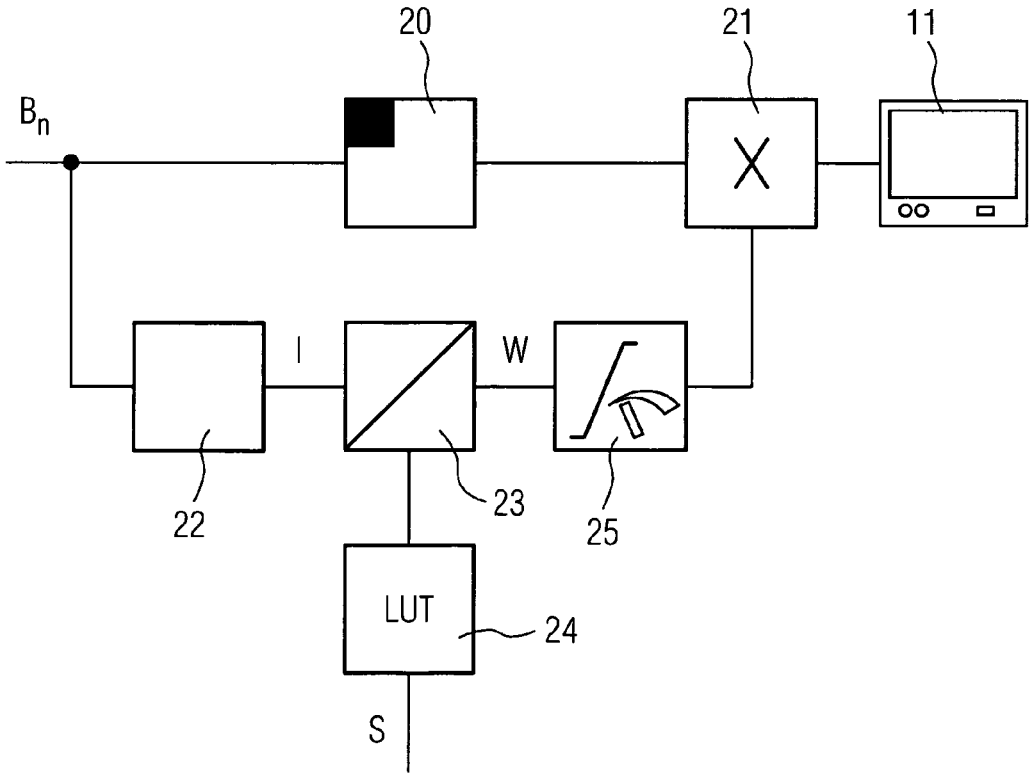
FIG. 2 shows an embodiment of a circuit arrangement for ABR without idle time according to FIG. 1.

The image enhancing controller (AVR) is described in more detail in FIG. 2. The current image signal B.sub.n is fed to an image memory 20, which is connected to a multiplication stage 21. The image signal B.sub.n of a circuit arrangement 22 is fed in parallel to the ROI average value formation to determine an actual value I, whereby the measurement field for the actual value determination corresponds with the measurement fields of the Iontomat chamber 5. The output signal is compared with an set value S in a comparison circuit 23, said set value S being changeable by means of a circuit arrangement 24 for the exposure correction. The output value W is calculated from the set value S and the actual value I according to the formula below:

$$W = \left(\frac{\text{Set value}}{\text{Actual value}}\right) * \text{n}$$

This value W is supplied to a limiter stage 25, which can be adjusted in his amplitude and or its limiter characteristics. The output signal of the limiter stage 25 is supplied to the multiplication stage 21, so that this value is multiplied with the pixel value of the image $B_n$ and reproduced onto the monitor 11.

The advantages are a high dose stability despite a Gx drop in the X-ray image amplifier. In the Iontomat chamber 5, the measurement fields are identical to the AGC measurement fields. The advantage of the 'new' AGC during recording is that no idle time of measurement value determinations results in the use of an actual value I. The circuit arrangement 24 for exposure correction accounts for the kV-path of the X-ray image amplifier 7.

By means of the arrangement according to the invention, all recordings can be exposed to the Iontomat chamber 5 in a manner appropriate to the dose. The image enhancing controller (AVR) serves to adjust the Gx drop and other non-linear properties of the X-ray image amplifier. Additionally, the kV dependencies of the brightness of the image amplifier are taken into account during exposure in the form of exposure corrections, for example by means of the look-up tables (LUT) in the circuit arrangement 24 for exposure correction. Both the systematic properties of this indirect exposure method and the non-systematic are taken into account by means of the mentioned AVR without idle time.

The set value of the AVR is adapted for the exposure correction desired by the user in digital radiography.

In the case of AVR without idle time, the image $B_n$ in the image memory 20 is buffered until the following processing is carried out in the circuit arrangements 22 to 25.

The actual value I of the brightness is initially generated in the circuit arrangement 22 for ROI average value formation. Here it is decisive that the measurement fields for the actual value determination coincide as well as possible with the measurement fields of the Iontomat chamber 5.

The set/actual value comparison is carried out in the comparison circuit 23, and the factor is determined by means of which the image $B_n$ must be multiplied. The set value S can be changed by means of the circuit arrangement 24 for exposure correction and also as a function of the type of operation or even of an exposure correction.

In the limiter stage 25, the factor determined in the comparison circuit 23 is limited to a maximum defined amplification and/or weakening.

In the multiplication stage 21, the multiplication of the factor determined in the comparison circuit 23 is carried out using image data. The image $B_n$ is displayed on the monitor 11.

By means of the device according to the invention, a second exposure system can be dispensed with. The optical system can be designed as a cost-effective compact optical system. The expensive tandem optic system with light decoupling is no longer necessary.

The recordings are exposed precisely for the dose. The dose/image no longer increases with the drop in the Gx of the image amplifier as is specified by the current prior art.

The routine adjustment of the system results in high customer satisfaction, since the adjustment no longer results in a lower dose/image.

The AVR without idle time enables the display of always correctly exposed images. No more brightness fluctuations occur during the adjustment processes. This is an important advantage with extremely slow image frequencies to the exposure of individual images.

The invention claimed is:

1. An X-ray diagnostic device for digital radiography, comprising:

a high voltage generator;

an X-ray tube for generating an X-ray bundle;

an image converter arranged downstream a patient relative to a radiation direction; and a control device connected to the high voltage generator for processing a signal related to a radiation dose, wherein the image converter includes (i) an exposure measurement chamber connected to provide the signal related to the radiation dose to the control device, from which signal the control device calculates a cut-off time for the high voltage generator; and (ii) an image enhancing controller for automatically calculating an image enhancing parameter, the image enhancing controller configured to be free of dead time.

2. The X-ray diagnostic device according to claim 1, wherein the image enhancing controller includes a matrix memory for storing images, the matrix memory connected to a first input of a multiplication unit, and a processing unit connected to an input of the matrix memory for calculating an ROI average value and for acquiring an actual value, the processing unit further connected to a comparator unit for comparing the actual value to a set value, the set value fed to a second input of the multiplication unit.

3. The X-ray diagnostic device according to claim 2, further comprising an exposure correcting unit connected to the comparator unit, the exposure correcting unit configured to adjust the set value.

4. The X-ray diagnostic device according to claim 2, further comprising a limiter unit connected to the comparator unit and to the second input of the multiplication unit.

5. The X-ray diagnostic device according to claim 2, wherein the exposure measurement chamber and the processing unit include measurement fields having identical arrangements or spatial positions.

6. The X-ray device according to claim 3, wherein the exposure correcting unit includes look-up tables including relationships between a brightness value of an image enhancing unit and voltage values to be fed to the X-ray tube, the voltage values given in kV.

7. The X-ray diagnostic device according to claim 1, wherein the image converter comprises an X-ray image enhancing and television unit including an X-ray image enhancing unit, optics and a television camera.

8. The X-ray diagnostic device according to claim 7, wherein the television camera includes a video camera.

9. The X-ray diagnostic device according to claim 7, wherein the television camera includes a CCD image converter.

10. The X-ray diagnostic device according to claim 1, wherein the image converter includes a solid body image converter.

11. The X-ray diagnostic device according to one of the claim 1, wherein the image converter includes a target device for recording an X-ray film.

* * * * *